United States Patent [19]

Preston et al.

[11] Patent Number: 4,593,706

[45] Date of Patent: Jun. 10, 1986

[54] PRODUCING FILLER MATERIAL, PARTICULARLY FOR CIGARETTE FILTERS

[75] Inventors: Edward G. Preston, London, England; David B. Stewart, Dundee, Scotland

[73] Assignee: Molins Limited, Great Britain

[21] Appl. No.: 289,481

[22] Filed: Aug. 3, 1981

[30] Foreign Application Priority Data

Aug. 4, 1980 [GB] United Kingdom ..... 8025342
Dec. 12, 1980 [GB] United Kingdom ..... 8039931

[51] Int. Cl.[4] ..... A24C 5/14; B31C 13/00; B32B 19/00

[52] U.S. Cl. ..... 131/109.1; 131/84.1; 493/42; 493/50; 156/62.2; 156/62.4; 156/180; 156/441

[58] Field of Search ..... 131/109 R, 84 R, 84 A, 131/84 C, 84 B; 493/42, 39, 44, 46, 47, 49, 50; 156/276, 279, 180, 62.2, 62.4, 62.8, 286, 441; 19/13, 0.62, 66 T, 65 T, 302, 399, 0.35, 0.5, 306; 83/813

[56] References Cited

U.S. PATENT DOCUMENTS 2,774,680 12/1956 Hackney et al. ..... 131/341
2,931,748 4/1960 Müller ..... 131/341
3,658,626 4/1972 Berger et al. ..... 156/62.2
3,675,541 7/1972 Tokitomo et al. ..... 156/83
3,862,472 1/1975 Norton ..... 19/156.3
3,910,166 2/1974 Sexstone ..... 131/341
3,913,176 10/1975 Grossi ..... 19/0.35
3,918,126 11/1975 Wood ..... 19/145.7

*Primary Examiner*—V. Millin
*Attorney, Agent, or Firm*—Antonelli, Terry & Wands

[57] ABSTRACT

Filler material, particularly for cigarette filters, is produced by feeding a stream of substantially continuous fibres of filter material onto a pin roller having a surface carrying sharp projections in the form of pins and the pin roller is driven at a speed such that the fibres are rapidly accelerated so as to be broken by the pins into irregular lengths and are projected from the roller in random orientations. The broken fibres may be collected as a stream for delivery to a rod-making unit by showering onto a conveyor band, by continuously rolling the fibres between cooperating rollers, or pneumatically. More than one stream could be supplied to the pin roller, so that the broken fibres can comprise a mixture of fibres of different filter materials. The broken fibres may be received on a substantially continuous carrier stream, comprising similar or different filtering material, before the fibres and carrier stream are formed into filter rod.

25 Claims, 12 Drawing Figures

PRODUCING FILLER MATERIAL, PARTICULARLY FOR CIGARETTE FILTERS

This invention relates to an apparatus and method for producing filler material, particularly for cigarette filters.

Cigarette filters have commonly been made from filter tow which consists of a cluster of crimped monofilaments, usually of cellulose acetate. The tow is drawn from a bale, is stretched by differential-speed rollers to separate the filaments and spread them out evenly, and is finally compressed to form a stream having the cross-section of the completed filters. A plasticiser such as triacetin is usually sprayed onto the filaments while they are spread out. The compressed stream of filaments may be enclosed in a continuous wrapper or may be set by means of steam or some other source of heat to form a continuous rod which is then cut at regular intervals.

One aspect of the present invention provides apparatus for producing filler material from a substantially continuous stream of filaments, including a conveyor having a surface adapted to engage said filaments, means for guiding the stream towards the conveyor, means for driving the conveyor such that the filaments of the stream are engaged by said surface and broken into irregular lengths, and means for receiving the broken filaments in a stream in which they are at least initially randomly orientated. Preferably the broken filaments are projected from the conveyor in random orientations. The receiving means may be arranged to feed the stream to a rod-forming device in which the stream is laterally compressed and formed into a continuous rod. The conveyor surface preferably has sharp projections for engaging the filaments, and a wall may be provided defining with said conveyor a channel through which filaments on said conveyor pass, said projections extending across said channel substantially to said wall. The projections may be forwardly-inclined relative to the direction of movement of the conveyor surface. The conveyor could be a pin roller.

We have found by experiment that a pin roller, used in accordance with this invention, is a particularly effective and reliable means of breaking up continuous monofilaments of filter tow so as to produce a stream of randomly orientated filaments. Our experiment was carried out with a typical crimped filter tow of cellulose acetate. Although the crimping is assumed to assist the pins in gripping the filaments so as to break them, we envisage that it might be possible to carry out this invention with filaments which are crimped less than is desirable in the case of conventional filter manufacture, and possibly not at all. Reduced crimping, or the elimination of crimping, would reduce the cost of the initial filter tow material.

The receiving means may include means for showering the broken filaments, preferably onto a conveyor band, and may include means for reducing the width of the stream on said band. Alternatively the receiving means could comprise means for forming a roll from said stream so that the filaments tend to follow a helical path about a longitudinal axis of the stream. The roll forming means could be a pair of cooperating rollers. The receiving means could comprise pneumatic means, which could supply a stream directly to a rod-shaping device.

Where the apparatus is used for filter production the guiding means could be adapted to feed conventional filter tow and include means for blooming the tow or it could include means for fibrillating a web of other filter material.

The guiding means could be arranged so that at least two different streams are engaged by the conveyor and so a mixture of broken filaments is produced. There could be a plurality of said conveyors, and a common receiving means so that the stream of filaments collected includes filaments from at least two different conveyors.

Fluid additive, such as plasticiser, where required, could be applied by the guiding means, i.e. before the filaments are broken, or by the conveyor which breaks the filaments, or by the receiving means or downstream of it.

The receiving means may include means for conveying a carrier stream of filamentary material onto which said broken filaments are deposited. The guiding means may include means for splitting the stream into a first stream which passes to said conveyor and a second stream which becomes said carrier stream. Means may be provided for fibrillating a web of filler material to produce said carrier stream. Means may be provided for applying fluid additive to the carrier stream before the broken filaments are deposited on it.

According to another aspect the invention provides a method of producing filler material from a substantially continuous stream of filaments, wherein each filament of the stream is engaged and accelerated so that the filament is broken and the stream is converted into filaments of irregular length, and the broken filaments are received in a stream in which they are at least initially randomly orientated.

The random orientation of the filaments reduces the amount of filter material which is needed to produce filters of given characteristics. Since conceiving the present invention, we have noted U.S. Pat. No. 3,658,626 which describes a method of making filters by chopping filter tow into "staple fibers" which are then blown into a rod-forming device. The expression "staple fibers" presumably relates to fibres of substantially uniform length such as would be produced by a chopping device. In contrast, apparatus in accordance with the present invention is not intended to produce fibres of uniform length; while it is desirable to produce some relatively short fibres in random orientations, we believe that it is also desirable for some of the fibres to be somewhat longer as that can help in producing a relatively . coherent stream of fibres prior to arrival in the rod-forming device. The length of the longest fibres may be several times greater (e.g. 10 times) than that of the shortest fibres.

The invention further comprises a rod-like article, especially a filter for a cigarette, comprising a filler of randomly-orientated filaments of irregular length.

The invention still further provides a rod-like article, especially a filter for a cigarette, comprising a filler comprising filaments of irregular length, a substantial number of which are arranged to follow a generally helical path about a longitudinal axis of the article.

Yet another aspect of the invention provides apparatus for producing filter rod, comprising means for producing a filler stream of relatively short filaments from a first stream of filter material, means for conveying a carrier stream of relatively long filaments of a filter material, means for depositing the filler stream on the carrier stream, and means for forming continuous filter rod from the combined filler and carrier streams. Preferably the carrier stream consists of part of said first stream. Alternatively the carrier stream consists of a fibrillated web of filter material.

The invention also includes a filter rod comprising a core of filaments of filter material of relatively short length randomly arranged and an outer layer of relatively long filaments of filter material.

The invention will be further described, by way of example only, with reference to the accompanying diagrammatic drawings, in which.

Figure 1:
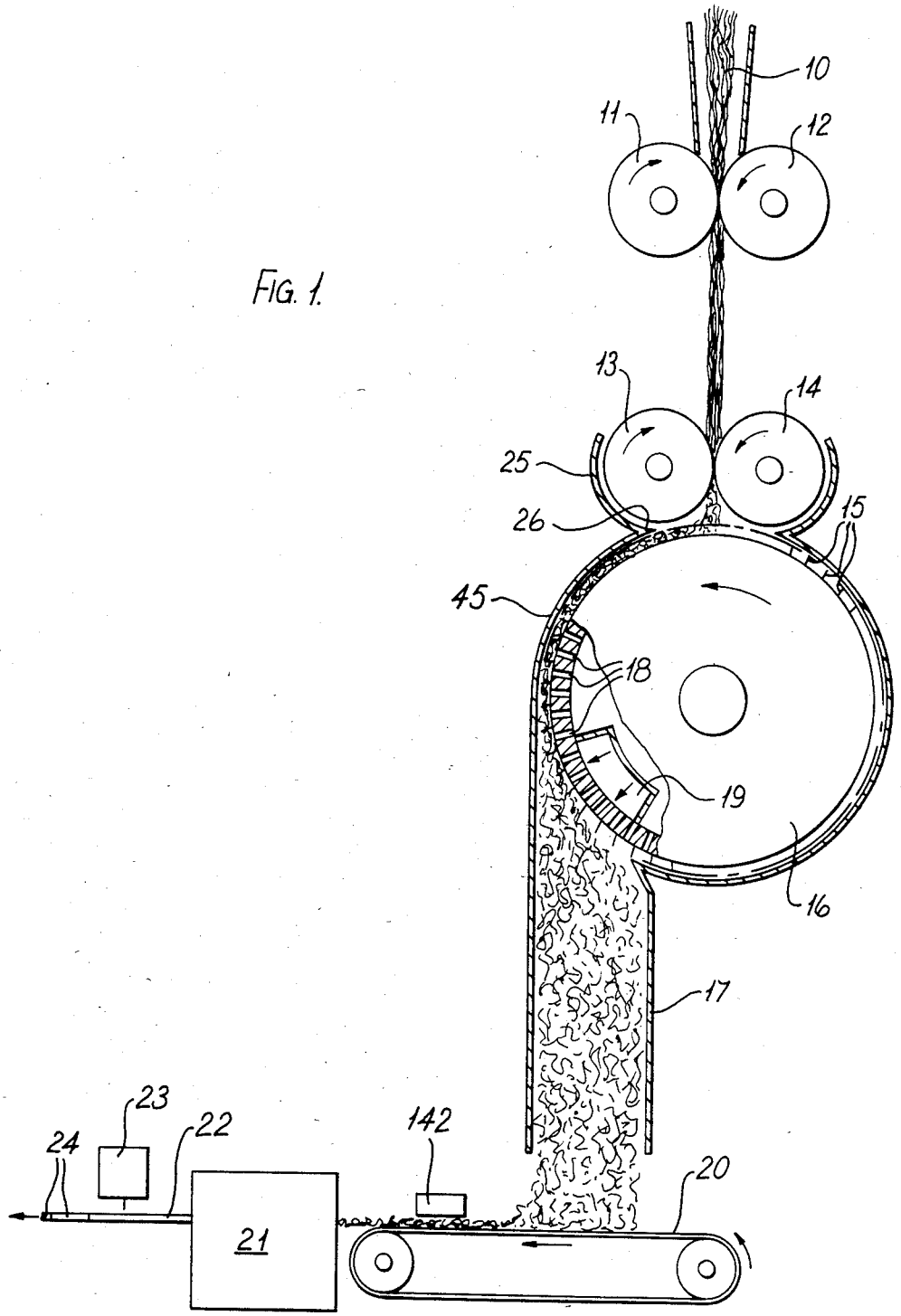
FIG. 1 is a side view of a machine for producing filter rod.

FIG. 1 shows crimped filter tow 10 being fed downwards between rollers 11 and 12 and then between rollers 3 and 14 which rotate at a higher speed than the rollers 11 and 12 so as to stretch the tow. If the tow 10 is uncrimped the rollers 11, 12 are unnecessary. On leaving the rollers 13 and 14, the tow is caught by pins 15 on the periphery of a roller 16 rotating at a high speed, e.g. approximately 5000 R.P.M. or generally within the range 1000 to 8000 R.P.M.

The pins 15 of the roller 16 engage the monofilaments of the filter tow and break them into portions of various lengths which are initially conveyed further by the roller 16 before being delivered into a downwardly extending duct 17. The periphery of the roller may, as shown, be formed with approximately radial passages 18 through which air is blown outwards from a manifold 19 to assist in removing the filaments from the roller; alternatively, air at atmospheric pressure may be admitted into the manifold 19 and may be displaced through the passages 18 by a centrifugal pumping action. In the upper region of the roller 16, there may be suction to help in pulling the fibres onto the roller.

On leaving the roller 16, the broken filaments are randomly orientated. They continue that way, e.g. on a conveyor band 20 (shown diagrammatically) which delivers a stream of the filaments to a rod-forming device 21. Suction may be applied through the band 20 to locate the filaments and convey the stream. This device forms a continuous filter rod 22 which is then cut at regular intervals by a cutting device 23 to produce individual rods 24.

The tow feed, including the rollers 11 to 14, may take various known forms. One example is described in United States Defensive Publication T 941,011, which is referred to in its entirety. The tow feed may in general include means for "blooming" the tow pneumatically in any known manner. Also there may be means for applying plasticiser, e.g. in any known manner; alternatively, plasticiser may be blown out through the passages 18 or otherwise applied after the tow has reached the roller 16 and at least partially been broken. A basic tow feed arrangement which may be used is shown diagrammatically in U.S. Pat. No. 3,658,626; in this connection it should be noted that other details described in that U.S. patent and in the related U.S. Pat. No. 3,377,220 (apart from the tow chopping arrangement) may be employed in carrying out the present invention; for example, a non-wrapped filter rod may be produced in the manner described mainly in U.S. Pat. No 3,377,220.

The rollers 11 to 14 shown in FIG. 1 (or one roller of each pair) may be axially fluted or may be rubber-coated so as to grip the tow or may be conventional so-called threaded rollers having circumferential grooves.

It should be noted that a curved wall 45 forming an extension of one wall of the duct 17 passes around the roller 16 and together with a curved wall 25 around the roller 13, forms a scraper 26 which helps to ensure that the broken filaments of tow continue on the roller 16, rather than passing round the roller 13. The wall 25 is mounted as close as possible to the roller 13 for that purpose, allowing only running clearance.

The tips of the pins 15 on the roller 16 are as close as possible to the surfaces of the rollers 13 and 14, again allowing just running clearance.

Figure 8:
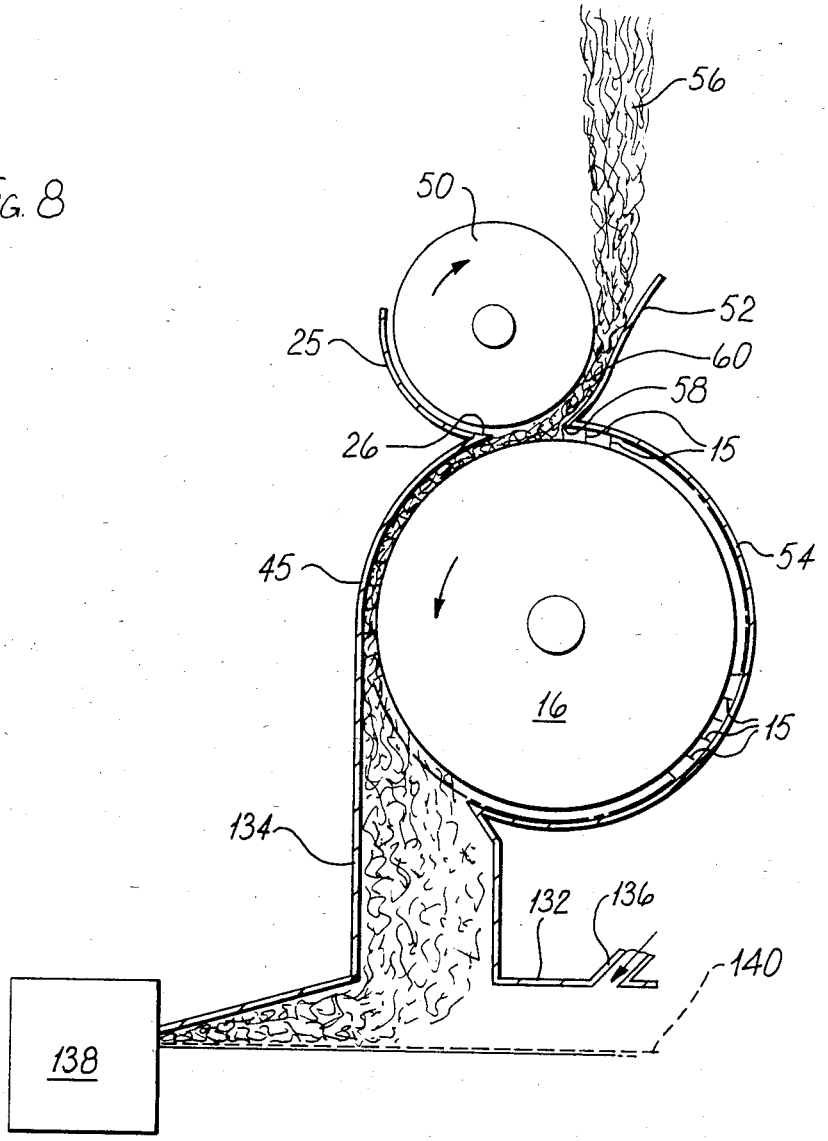
FIG. 8 is a side view of yet another modification of the machine of FIG. 1.

FIG. 8 shows a modified arrangement in which the rollers 11–14 are replaced by a single roller 50 placed in a similar position to the roller 13 and cooperating with an opposed guide 52 which is connected to a rear wall 54 surrounding the pin roller 16. Part of the guide 52 converges towards the roller 50 and serves to guide the tow stream 56 onto the roller. Downstream of this part, adjacent its connection 58 to the wall 54, the guide 52 follows the periphery of the roller 50 and defines a lead-in channel 60 for the pin roller 16. As compared with the FIG. 1 arrangement the tow is more restricted at the position of initial contact with the pin roller 16; this may have the advantage that shorter fibres can be produced. As with the FIG. 1 arrangement the clearance allowed for the pins 15 (by the walls 45, 54 and roller 50) is minimal.

Figure 2:
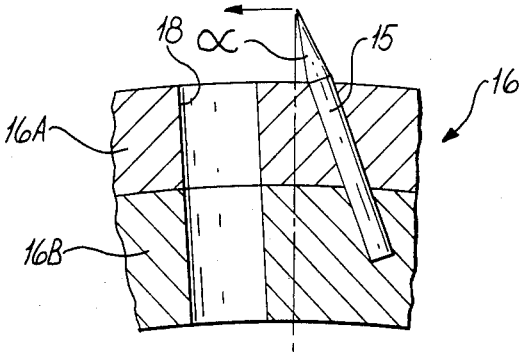
FIG. 2 is an enlarged section of a portion of a pin roller in a plane normal to the axis of the roller.

FIG. 2. is an enlarged section of part of the peripheral portion of the drum 16, showing one of the pins 15 and one of the radial passages 18. In particular, it shows that each of the pins 15 is forwardly inclined. Not only is the axis of the pin inclined to a radius of the roller, but the front face of the tapered outer end of the pin is preferably inclined to a radius at that point by an angle $\alpha$ which is preferably approximately 10 to 15 degrees but may generally be within the range 5 to 40 degrees. The passage 18 is shown radial, but it may instead be inclined at the same angle as the axis of the pins.

The roller itself may be of aluminium. Within a peripheral portion 16A of the roller 16 there is preferably a moulded sleeve 16B of plastics material in which the inner ends of the pins are encased as shown in FIG. 2.

Figure 3:
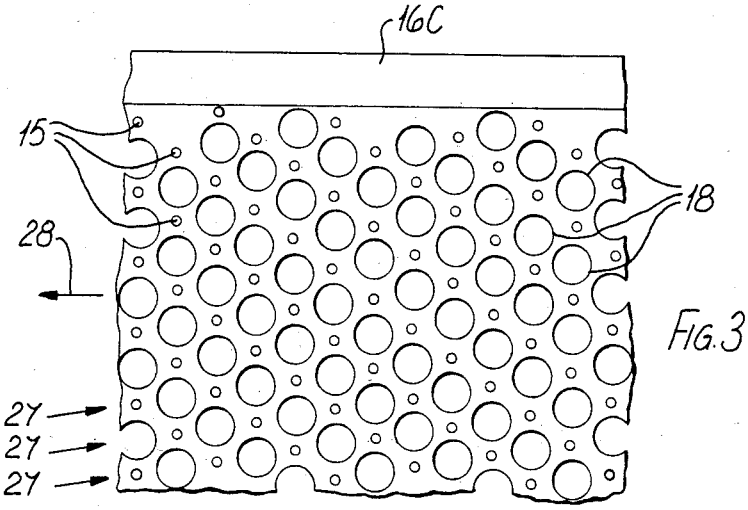
FIG. 3 is an elevation on an enlarged scale of part of the surface of the roller of FIG. 2.

FIG. 3 shows one preferred arrangement of the pins and air passages in the periphery of the roller 16. The pins lie in rows 27 which are inclined by a small angle to their direction of movement (shown by the arrow 28). Furthermore, the pins within adjacent rows are staggered with respect to one another. This, coupled with the high speed of rotation of the roller, helps to ensure that no filament can move for any significant distance around the roller 16 without being engaged by one of the pins. On each side of the roller there is a flange 16C (only one of which is shown) which projects radially so that its surface is flush with the tips of the pins. The width of the roller 16 (between the flanges) may be approximately 200–250 mm. to accommodate the normal width of the spread stream of filter tow. Alternatively the tow stream fed to the roller 16 could be narrower so that the roller need not be as wide as this; the roller and stream could be as narrow as 25–100 mm.

Figure 4:
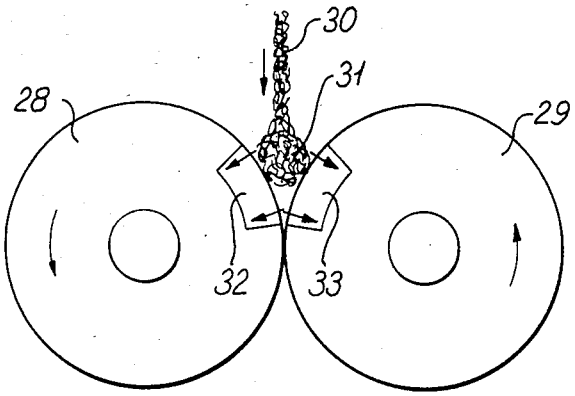
FIG. 4 shows a modified arrangement for collecting a stream of broken fibres on two rollers.

FIG. 4 shows one possible way of collecting the shower of broken filaments or fibres received from the duct 17 in FIG. 1. It includes two rollers 28 and 29 mounted close to one another and rotating at the same speed and in the same direction. A stream of broken fibres 30 is delivered into the nip between the rollers and is formed into a gently rotating roll 31 which then proceeds axially along the rollers as a stream with some degree of coherence. Each of the rollers has a porous periphery through which suction is applied to the fibres from a suction chamber 32 or 33 to assist in drawing the fibres against the rollers. Alternatively, one of these suction chambers may be omitted.

Figure 5:
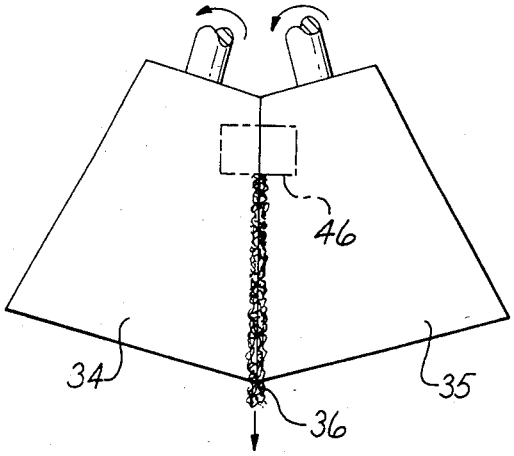
FIG. 5 is a plan view of a modification of the arrangement of FIG. 4.

FIG. 5 is a plan view of a modified roller arrangement basically like FIG. 4. Instead of cylindrical rollers, there are two conical rollers 34 and 35 rotating in the same direction, as in FIG. 4. A stream of randomly orientated broken filaments or fibres is delivered into the nip between the rollers at an area 46 adjacent to the smaller-diameter ends of the rollers. Thus centrifugal force on the fibres has a component which moves a fibre roll 36 towards the larger-diameter ends of the rollers.

The fibre roll in FIG. 4 or FIG. 5 may be delivered onto a continuous wrapper web or into a rod-forming device for producing a non-wrapped filter rod.

Figure 6:
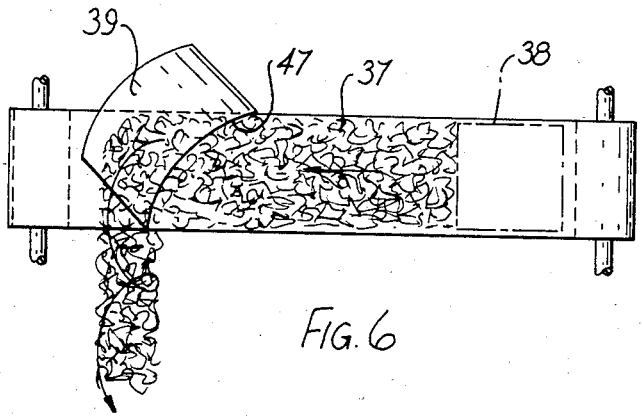
FIG. 6 is a plan view showing another modification of the machine shown in FIG. 1.

FIG. 6 is a plan view of a conveyor 37 similar to the conveyor 20 in FIG. 1. Broken fibres are delivered onto the conveyor 37 in the area 38 and are deflected from the conveyor 37 by a concave plough 39 which is bodily inclined to the conveyor 37 and has its leading edge 47 generally inclined to the direction of movement of the conveyor 37. The arrangement is such that the stream of fibres is scooped from the conveyor 37 by the plough 39, which also imparts a degree of rotary motion at the same time to produce a roll of fibres somewhat in the manner of FIGS. 4 and 5.

Figure 7:
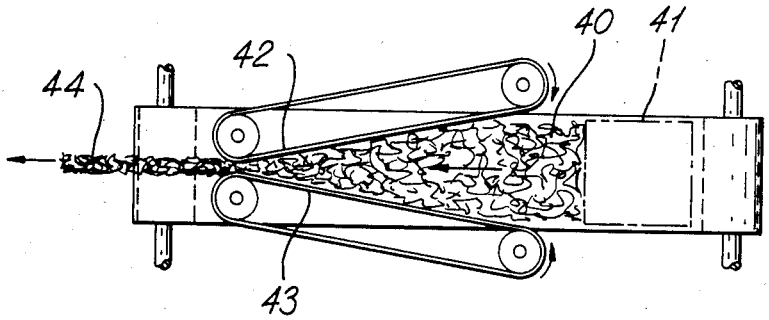
FIG. 7 is a plan view of a further modification of the machine of FIG. 1.

FIG. 7 shows a conveyor band 40 onto which fibres are delivered over an area 41, and side bands 42 and 43 which converge while moving in the same direction as the band 40 so as to gather in the fibres. A narrow stream 44 of randomly orientated fibres is thus produced and is fed to a rod-forming device (not shown). In place of the converging bands 42 and 43, there may be converging fixed side walls.

The band 40, and also the similar bands in FIGS. 1 and 6, may be porous and suction may be transmitted through it from below so as to grip the fibres onto the band where appropriate. For example, in FIG. 7, the suction chamber may be tapered so that its sides correspond to the converging bands 42 and 43.

In the absence of converging bands 42 and 43, there may be converging air pressure manifolds, above the band 40 or below it, from which air jets are directed inwards to displace the fibres towards the centre of the conveyor 40 as they move on the conveyor. Alternatively, other means may be provided for gathering in a relatively wide stream of fibres to produce a narrow stream such as can be compressed readily to the cross-section of a finished cigarette filter e.g. as described in U.S. Pat. No. 3,548,837.

Another possibility is that the broken fibres delivered by the roller 16 may be showered and formed into a narrow stream in the manner of a cigarette making machine, e.g. the Molins Mark 6, 8 or 9 machine, the Hauni Garant machine or the SASIB:SIGMA machine. Other possible ways of collecting the stream of fibres are as disclosed in British Patent Specification No. 2048968. If the fibres are sufficiently short, it might be possible to trim the stream (as practised in modern cigarette making machines) before delivering the stream to a rod-forming device.

As an idea of scale (but by way of example only) the roller 16 shown in FIG. 1 has a diameter of 120 mm. The pins 15 project 3 mm from the peripheral surface of the roller and are spaced apart in the rows 27 (FIG. 3) at intervals of 7 mm.

Instead of gripping the broken fibres by the action of suction applied through it, the conveyor 20 shown in FIG. 1 (and conveyors 37 and 40 in FIGS. 6 and 7) may be electrostatically charged to grip the fibres where necessary. Similarly, one or both of the rollers 28 and 29 in FIG. 4 may be electrostatically charged to tend to grip the fibres in place of suction; it will be understood the rollers would, for that purpose, be made of a suitable non-conducting material.

Another possibility is that the fibres leaving the roller 16 may enter through the side of a horizontally extending pipe through which air is blown to propel the fibres, e.g. directly into the rod-forming device. The air may be blown obliquely into the pipe so as to produce a vortex tending to roll the stream of fibres. This arrangement is indicated in FIG. 8, where a substantially horizontal pipe 132 extends below the chute 134 and includes oblique air inlets 136. The stream thus produced is delivered to a rod making unit 138.

The average length of the broken filaments leaving the roller 16 will generally depend upon the speed of the roller 16 in relation to that of the tow 10, on the density of pins on the roller, on the strength of the monofilaments, and on the friction between the filaments on the one hand and the pins and roller surface on the other hand. In a test which we performed, using tow of average denier, e.g. total denier 40–50,000 and 3–4 dpf, the broken filaments were between about 6 mm and about 60 mm long.

Instead of rotating unidirectionally, the rollers 28 and 29 in FIG. 4 may both oscillate at the same speed and frequency so that they are both rotating at the same speed and in the same direction at any given moment in time. For example, the peripheral stroke of each roller may be in the region of 25 to 100 mm; the frequency of oscillation may be as high as 3,000–10,000 cycles per minute. Movement of the stream of fibres 31 may be assisted by a longitudinally directed air flow.

The same modification or modifications may be applied to the rollers 34 and 35 shown in FIG. 5.

In order to improve the filtering characteristics of the completed filters, an additional filtering material may be added to the stream of randomly orientated fibres used to produce the filter rod. For example, particles of carbon or other filtering material may be sprinkled on to the stream of fibres, by a unit 142 as indicated in FIG. 1 for example.

Another possibility is that broken fibres of a different material may be included with the cellulose acetate fibres. For example, the different material may comprise fibres of plastics material or of carbon, carbon based or carbon carrying material, the carbon in each case being preferably activated. Such material may be fed as continuous fibres and may be broken-up randomly by being fed to the roller 16 together with the cellulose acetate fibres, or by being fed to a separate roller corresponding to the roller 16. In either case, the fibres of additional material are preferably broken up randomly and are fed in random orientations into or together with the cellulose acetate fibres.

Figure 12:
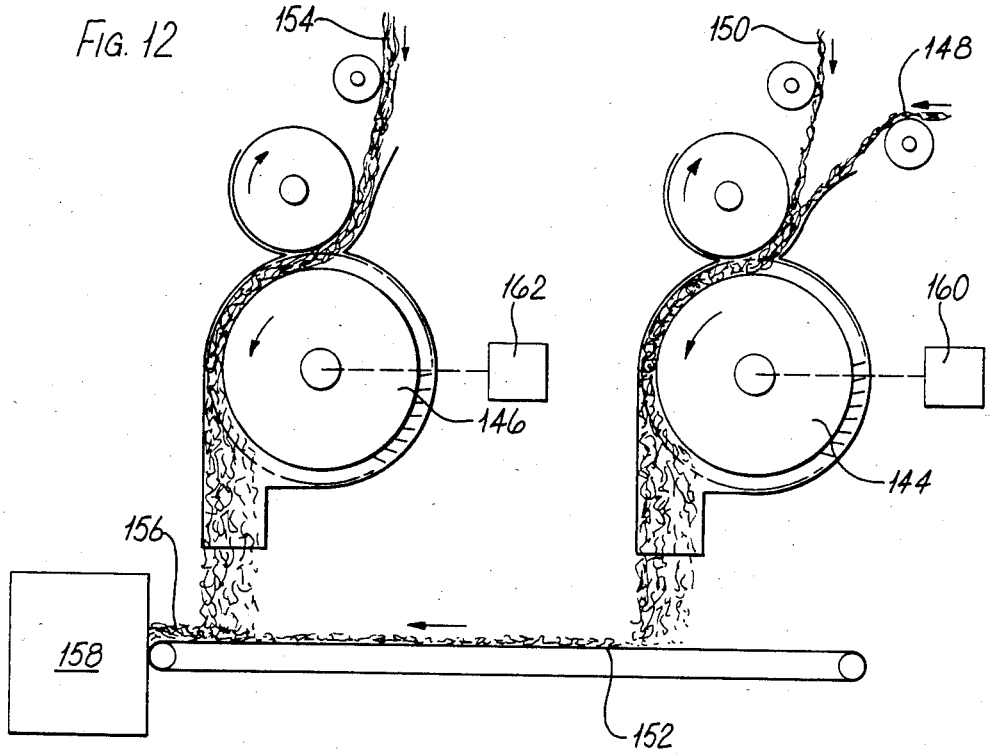
FIG. 12 is a side view of a still further machine for producing filter rod.

An arrangement including two pin rollers 144, 146, each similar to the roller 16, is shown in FIG. 12. A first stream 148 of fibrous filtering material is fed to the roller 144 together with a second stream 150 of a different fibrous filtering material, so that a mixture of broken fibres from the two streams is deposited on a band 152 below the roller. The band 152 passes beneath the other pin roller 146 to which a third stream 154 of a further different fibrous filtering material is supplied, so that at its downstream end the band 152 carries a stream 156 of broken fibres of the three different filtering materials, for delivery to a rod-making unit 158. The band 152 may be supplied with suction or other means to ensure positive conveyance of the stream.

As a means of controlling the filter manufacturing operation, the filter rod 22 or the stream of fibres used to form the filter rod may be continuously monitored as to its weight, for example by means of a nucleonic scanning device. In response to a signal from the nucleonic or other weight monitoring device, the rate at which the continuous cellulose acetate fibres is fed towards the roller 16 may be automatically controlled so as to maintain the weight per unit length of the completed filter rod substantially constant. Alternatively, or additionally, where trimming of the stream of broken fibres is provided, the signal may be similarly used to control the trimming device.

Figure 9:
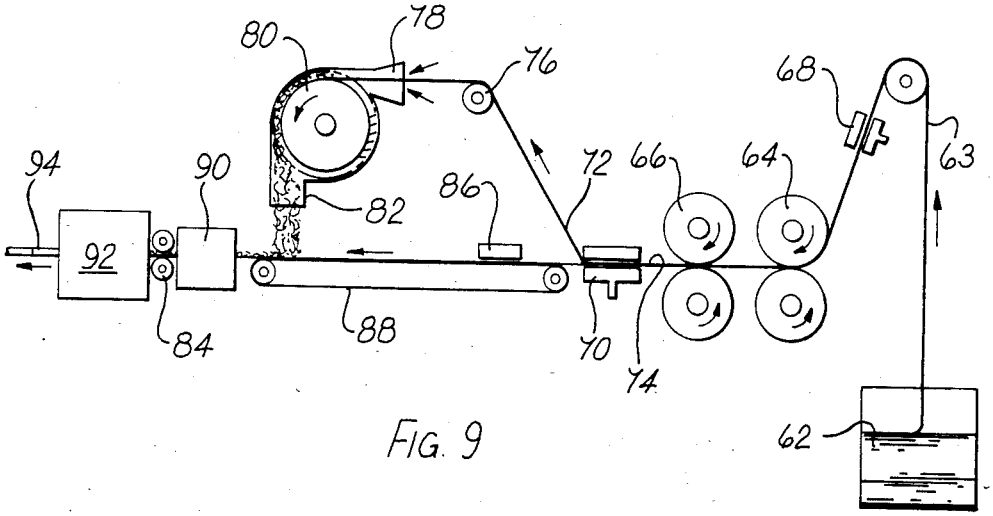
FIG. 9 is a side view of another machine for producing filter rod.

FIG. 9 shows a bale 62 of crimped filter tow from which a continuous stream 63 is drawn by pretension rollers 64 and stretching rollers 66. A banding jet 68 is provided upstream of the rollers 64 to spread the tow. Downstream of the rollers 66 a further banding jet or jets 70 are arranged to split the tow into two streams 72, 74. This may be achieved by directing the jet or jets 70 so that the stream 63 is laterally split. The main stream 72, which preferably comprises at least 70% of the tow in the stream 63 is directed upwards over a roller 76 and into a funnel-shaped transport jet 78 into which air is blown to convey the tow onto the periphery of a pin ro11er 80. The transport jet 78 may be similar to that disclosed in British Patent Specification No. 1588506 or in U.S. Pat. No. 3,016,945. The pin roller 80 acts on the tow stream 72 and produces a stream of broken fibres to a chute 82 in a manner similar to the pin roller 16 of FIG. 1.

The stream 74 comprising a part of the stream 63 after splitting by the banding jets 70 is conveyed forward (by downstream rollers 84) in substantial alignment with the stream 63 and passes direct1y beneath the chute 82. Additional banding jets 86, acting on the stream 74 may be provided for controlling its width prior to passage beneath the chute 82. The arrangement is such that the shower of broken fibres descending from the chute 82 falls on the banded tow stream 74 which subsequently acts as a carrier for those fibres. A conveyor band 88 could be provided to support the stream 74.

After the fibres from the pin roller 80 have been showered onto the carrier stream 74 both the fibres and the stream are passed through a plasticising chamber 90. Subsequently the plasticised stream and fibres are passed to a filter rod making unit 92 which forms filter rods 94. In the filter rod making unit 92 continuous filter rod is formed, which may be wrapped or unwrapped, as before. The rod shaping means in the unit 92 may be such that the carrier stream 74 is wrapped around the fibres rather in the manner that the paper wrapper is wrapped around a filler stream in a conventional rod forming unit. The rod 94 may therefore comprise a central core of broken filaments from the stream 72 encased in an annular sheath including the stream 74.

Figure 10:
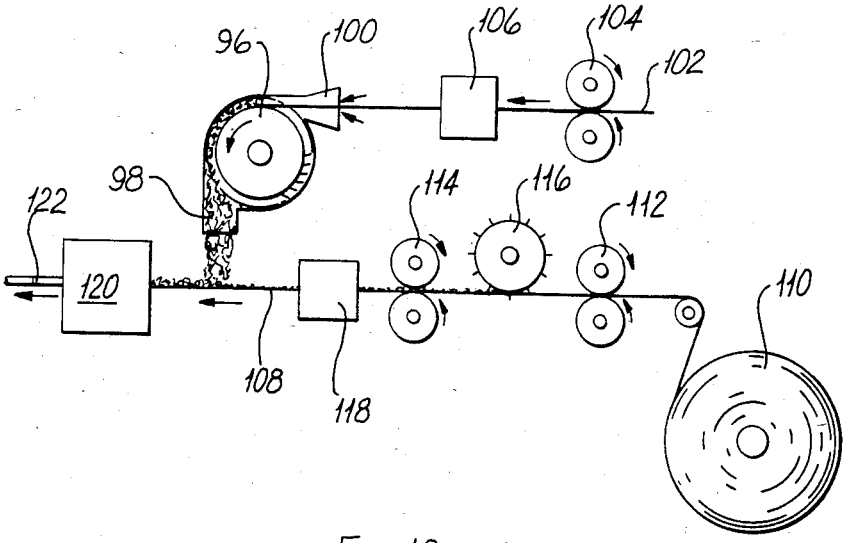
FIG. 10 is a side view of a further machine for producing filter rod.

FIG. 10 shows another machine for producing filter rod, including a pin roller 96 and chute 98 which are similar to the pin ro11er 80 and chute 82 of the machine of FIG. 9. A transport jet 100, which may be similar to the jet 78 of FIG. 9, is also provided. A tow stream 102 for delivery to the transport jet 100 is conveyed by rollers 104 from a tow bale (not shown). The rollers 104 could correspond to the rollers 66 of FIG. 9. The stream 102 passes through a plasticising chamber 106 before reaching the transport jet 100.

The broken fibres issuing from the chute 98 fall onto a carrier stream 108 comprising fibrillated sheet filter material. A continuous web of the sheet filter material is withdrawn from a reel 110 by rollers 112 and 114, between which the tension in the web is controlled. A fibrillating roller 116, preferably rotating at relatively high speed, makes a series of discontinuous slits in the web to form numerous substantially parallel fibres.

The roller 116 may be a pin roller substantially similar to the pin roller 16. Other ways of fibrillating a web of material are disclosed in British Patent Specifications Nos. 1073741, 1244982, 1298561, 1421324, 1421325, and 1440111, and in U.S. Pat. Nos. 3,474,611 and 3,675,541.

After fibrillation the stream 103 passes through a plasticising chamber 118 and beneath the chute 98 from which it receives the showered fibres from the stream 102. Subsequently the stream 108 and conveyed fibres are formed into a continuous rod in a rod making unit 120, which may be similar to the unit 92, and cut to produce filter rods 122.

The filter material of the reel 110 may be substantially similar to that of the stream 102 or may be different. Thus both streams 102 and 108 may be cellulose acetate, the stream 102 normally being in fibrous tow form and the stream 108 being initially in sheet form. However, one or both streams 102, 108 could be of alternative plastics fi1tering material, e.g. polypropylene, in which case plasticising is normally unnecessary. Where plasticising is necessary this could be carried out downstream of the position where the broken fibres are fed onto the stream 108, i.e. in a similar position to the chamber 90 of FIG. 9. Similarly, in the FIG. 9 machine, the chamber 90 could be replaced with separate devices acting on the respective streams 72, 74 or even with a device acting upstream of the splitting banding jets 70. Even where plasticising would normally be necessary on materials of the kind used for both the carrier and the broken fibres such plasticising may not be necessary for either the carrier or the filler since sufficient plasticiser to create a stable rod or otherwise modify the filter material could be supplied either to said carrier or said filler.

Possibly some migration of plasticiser may take place within the stream before final curing.

The plasticising chambers 90, 106, 118 could be substantially similar to conventional plasticising chambers, in which plasticiser is usually sprayed, e.g. as used on the AMCEL 103 tow unit, but could be of other forms. For example, the plasticiser may be foamed for application to the tow or other fibres substantially as a stream of foam. This could be particularly useful for preserving or creating coherence in a stream of broken fibres.

In the FIG. 10 arrangement an additional treatment station may be provided to produce crimp in the fibrillated web. This station may be located at or adjacent the chamber 118 and may include means for treating opposite sides of the web in different ways, e.g. with different fluid additives or amounts thereof, so that the filaments produced by fibrillation become crimped. Plasticising, if necessary, could then take place downstream of this additional treatment station, and could be performed after showering from the chute 98 has taken place.

As already indicated the material from which the broken fibres are produced need not be cellulose acetate tow. Thus, any of the arrangements shown in FIGS. 1, 4–10, or 12 could be supplied with alternative material capable of being fed as a substantially coherent stream but separable into fibres or particles. For example, any of the streams 10, 30, 63, 102, 148, 150, 154 could be fibrillated webs of cellulose acetate or other suitable material. Another such alternative material is foamed sheet material, e.g. foamed cellulose acetate or, more generally foamed or filled material having filtering properties, e.g. polypropylene. The action of a pin roller such as the roller 16 on such a material is to produce randomly orientated particles of varying length in a similar manner to that produced with conventional tow. The stream 102 could be supplied from a reel similar to the reel 110 and could comprise a flattened foam web of suitable material.

The carrier stream 108 could comprise a conventional tow stream. The reel 110 would be replaced by a tow bale and the tow bloomed in conventional manner. The filter material in the tow stream 102 may be different to that in the stream 108. In the FIG. 8 arrangement a carrier of suitable filter material, as indicated at 140 could be provided for the stream in pipe 132.

Figure 11:
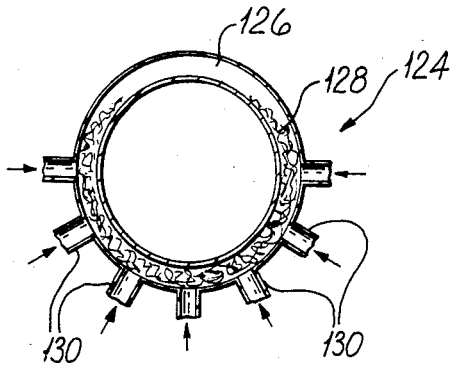
FIG. 11 is an enlarged sectional view of a modification of the machine of FIG. 9 or FIG. 10.

FIG. 11 shows in cross-sectional view a banding jet 124 comprising an annular passage 126 along which a tow stream 128 may be conveyed whilst subjected to the action of banding air streams, introduced for example through ports 130. The arrangement is such that the stream 128 is spread around the passage 126 so that it assumes a U-shape. The banding jet 124 could comprise a progressive change in shape from a conventional flat configuration to that shown in the drawing, so that the stream 128 is initially spread out in a substantially flat plane. Having obtained a U-shaped tow stream 128 this can advantageously be used as a carrier stream for broken tow fibres showered onto it, (or otherwise delivered onto it). For example, a banding jet 124 could be located downstream of the jet 86 in FIG. 9 to act on the stream 74. Similarly a guide similar to the banding jet 124 could be provided to preshape appropriately the stream 108 in FIG. 10.

In the machine shown in FIG. 12 driving means 160, 162 for the respective pin rollers 144, 146 is indicated diagrammatically. This may take any convenient form and may, for example, comprise separately controlled motors or chain and sprocket connections to a main motor for the rod forming unit 158. It will be understood that drive for the rollers 16, 80, and 96 may be derived in a similar way.

The possibility of trimming a stream of broken fibres has already been mentioned. Particularly where impregnation of fluid additive has already taken place this may result in rapid fouling of conventional trimming devices; an acceptable alternative would be to use a high speed air stream or other trimming device which does not directly contact the stream.

It has already been mentioned that polypropylene or other plastics materials in suitable form (e.g. fibrous, possibly produced by fibrillating basic sheet material which might be foamed or filled) or carbon fibres might be used instead of (or in addition to) cellulose acetate tow for production of broken fibres or particles. A suitable material is a filled polypropylene marketed by the Shell Chemical Company under the trade mark CARIFIL.

We claim:

1. Apparatus for producing filler material for products of the cigarette industry from a substantially continuous stream of filaments, including a conveyor having a surface carrying sharp projections adapted to engage said filaments, means for feeding and guiding the stream towards the conveyor and into engagement with said sharp projections, means for driving the conveyor at a high speed relative to the stream of filaments such that end portions of the filaments of the stream are rapidly accelerated as they are engaged by said projections so that said filaments are broken into irregular lengths, and means for receiving the broken filaments in a stream in which they are at least initially randomly oriented.

2. Apparatus according to claim 1, wherein the receiving means includes means for feeding the stream of broken filaments to a rod-forming device in which the stream is laterally compressed and formed into a continuous rod.

3. Apparatus according to claim 1, including a wall defining with said conveyor a channel through which filaments on said conveyor pass, said projections extending across said channel substantially to said wall.

4. Apparatus according to claim 1, wherein the projections are forwardly inclined relative to the direction of movement of the conveyor surface.

5. Apparatus according to claim 1, wherein the receiving means includes means for showering broken filaments.

6. Apparatus according to claim 5, wherein the receiving means includes a conveyor band.

7. Apparatus according to claim 6, including means for reducing the width of the stream on said band.

8. Apparatus according to claim 1, wherein the feeding and guiding means including means for blooming a tow of filter material.

9. Apparatus according to claim 1, wherein the feeding and guiding means includes means for applying fluid additive to the stream.

10. Apparatus according to claim 1, wherein said feeding and guiding means is arranged so that at least two different streams may be engaged by said conveyor.

11. Apparatus for producing filler material for products of the cigarette industry from a substantially continuous stream of filaments, including a conveyor having a surface carrying sharp projections adapted to engage said filaments, means for feeding and guiding the stream towards the conveyor, means for driving the conveyor at a speed such that the filaments of the stream are engaged by said surface and accelerated so as to be broken into irregular lengths, and means for receiving the broken filaments in a stream in which they are at least initially randomly orientated, wherein apertures are provided in said conveyor surface.

12. Apparatus according to claim 11, including means for blowing air through said apertures to propel filaments away from the surface.

13. Apparatus according to claim 11, including means for applying a treating fluid to the filaments through said apertures.

14. Apparatus for producing filler material for products of the cigarette industry from a substantially continuous stream of filaments, including a conveyor having a surface carrying sharp projections adapted to engage said filaments, means for feeding and guiding the stream towards the conveyor, means for driving the conveyor at a speed such that the filaments of the stream are engaged by said surface and accelerated so as to be broken into irregular lengths, and means for receiving the broken filaments in a stream in which they are at least initially randomly orientated, wherein the conveyor is a pin roller.

15. Apparatus according to claim 14, wherein the pins are arranged on said roller in closely spaced staggered rows.

16. Apparatus according to claim 14, wherein said driving means is arranged to rotate the roller at a speed in the range 1000–8000 R.P.M.

17. Apparatus for producing filler material for products of the cigarette industry from a substantially continuous stream of filaments, including a conveyor having a surface adapted to engage said filaments, means for feeding and guiding the stream towards the conveyor, means for driving the conveyor at a speed such that the filaments of the stream are engaged by said surface and acclerated so as to be broken into irregular lengths, and means for receiving the broken filaments in a stream in which they are at least initially randomly orientated, wherein the receiving means includes means for forming a roll from said stream so that the filaments tend to follow a helical path about a longitudinal axis of the stream.

18. Apparauts according to claim 17, wherein the roll forming means includes a pair of cooperating rollers.

19. Apparatus for producing filler material for products of the cigarette industry from a substantially continuous stream of filaments including a conveyor having a surface adapted to engage said filaments, means for feeding and guiding the stream towards the conveyor, means for driving the conveyor at a speed such that the filaments of the stream are engaged by said surface and accelerated so as to be broken into irregular lengths, and means for receiving the broken filaments in a stream in which they are at least initially radomly orientated, wherein the receiving means includes pneumatic means for directing filaments of the stream.

20. Apparatus according to claim 19, wherein the pneumatic means is arranged so that the filaments of the stream are supplied directly to a rod-shaping device.

21. Apparatus for producing filler material for products of the cigarette industry from a substantially continuous stream of filaments, including a conveyor having a surface adapted to engage said filaments, means for feeding and guiding the stream towards the conveyor, means for driving the conveyor at a speed such that the filaments of the stream are engaged by said surface and accelerated so as to be broken into irregular lengths, and means for receiving the broken filaments in a stream in which they are at least initially randomly orientated, including a plurality of said conveyors, and a common receiving means so that the stream of filaments received includes filaments from at least two different conveyors.

22. A method of producing filler material for products of the cigarette industry from a substantially continuous stream of filaments, comprising the step of feeding the stream towards a conveyor carrying a plurality of projections moving at high speed relative to said stream so that each filament is engaged by one or more projections causing that filament to be accelerated and broken and the stream to be thereby converted into filaments of irregular lengths, and forming a stream from the broken filaments in which the filaments are at least initially randomly oriented.

23. A method according to claim 22, wherein the broken filaments are projected from the conveyor in random orientations.

24. Apparatus for producing filler material for products of the cigarette industry from a substantially continuous stream of filaments, including a conveyor having a surface adapted to engage said filaments, means for feeding and guiding the stream towards the conveyor, means for driving the conveyor at a speed such that the filaments of the stream are engaged by said surface and accelerated so as to be broken into irregular lengths, and means for receiving the broken filaments in a stream in which they are at least initially randomly orientated, including means associated with said receiving means for determining the quantity of broken filaments in said stream, and means responsive to said determining means for controlling said quantity.

25. Apparatus for producing material consisting of a mixture of long and short filaments from a substantially continuous stream of filaments, including a pin conveyor having a surface carrying sharp projections adapted to engage said filaments, means for feeding and guiding the stream towards the conveyor, means for driving the conveyor at a speed such that the filaments of the stream are engaged by said surface and accelerated so as to be broken into irregular lengths, and means for receiving the broken filaments in a stream in which they are at least initially randomly orientated.

* * * * *